US006457323B1

(12) United States Patent
Marotta

(10) Patent No.: US 6,457,323 B1
(45) Date of Patent: Oct. 1, 2002

(54) RELATIVE HUMIDITY-CONTROLLED ISOTHERMAL CONTAINER FOR TRANSPORTING PERISHABLE GOODS AT DIFFERENT TEMPERATURES

(75) Inventor: Carmine Marotta, Naples (IT)

(73) Assignee: Saldogas S.r.L., Naples (IT)

( * ) Notice: Subject to any disclaimer, the term of this patent is extended or adjusted under 35 U.S.C. 154(b) by 0 days.

(21) Appl. No.: 09/625,614

(22) Filed: Jul. 26, 2000

(30) Foreign Application Priority Data

Jul. 30, 1999 (IT) ..... NA99A0038

(51) Int. Cl.[7] ..... F25D 3/08
(52) U.S. Cl. ..... 62/371; 62/60; 62/457.2
(58) Field of Search ..... 62/440, 441, 443, 62/457.2, 457.1, 371, 60, 263

(56) References Cited

U.S. PATENT DOCUMENTS

| | | | | | |
|---|---|---|---|---|---|
| 2,289,060 | A | * | 7/1942 | Merkle | 62/371 |
| 2,632,311 | A | * | 3/1953 | Sullivan | 62/371 |
| 5,117,777 | A | * | 6/1992 | Takasugi | 119/3 |
| 5,493,874 | A | * | 2/1996 | Landgrebe | 62/457.2 |
| 5,924,302 | A | * | 7/1999 | Derifield | 62/457.2 |

* cited by examiner

*Primary Examiner*—Denise L. Esquivel
*Assistant Examiner*—Melvin Jones
(74) *Attorney, Agent, or Firm*—Michael J. Striker

(57) ABSTRACT

The present invention discloses an isothermal container provided with inside compartments divided by movable partitions and capable of receiving refrigerating means. Such compartments can be provided laterally, centrally, on the upper side, and on the lower side, and a separate smaller container inside the main container can also be provided.

9 Claims, 2 Drawing Sheets

RELATIVE HUMIDITY-CONTROLLED ISOTHERMAL CONTAINER FOR TRANSPORTING PERISHABLE GOODS AT DIFFERENT TEMPERATURES

BACKGROUND OF THE INVENTION

In the field of the isothermal containers for transporting thermally perishable products the length of preservation of the product to be transported in the desired range of temperatures is a function of the following parameters:

1. Initial temperature of the product to be transported. In the production centres the product is usually stored in cold-storage rooms regulated at known, constant temperatures.
2. Mass and thermal capacity of the product to be transported. The greater the mass and the thermal capacity of the product to be transported, the lower the increase in temperature of the product under the same other conditions.
3. Outside shape of the container. Such shape determines both the surface of the container exposed to the environment, then the thermal exchange, and the outside total thermal exchange factor that, once the environment is determined, is a function of surface finishing, colour of the same, positioning of the surface with respect to the environment.
4. Thickness of the container walls. The larger the thickness of the container walls, the lower the thermal exchange factor relative to the thermal conduction established in the container walls.
5. Environment temperature. The higher the environment temperature, the greater the heat amount exchanged with the product contained in the container and the greater the increase in temperature of the product.

It is self-evident that, once the initial temperature of the product to be transported is determined, the length of conservation of the product to be transported in the desired range of temperatures is also determined by parameters 1, 2, 3, 4 and 5 described above. Such length is extremely limited in the today commercial applications since the materials used for making the containers are characterized by a thermal conductivity which permits a thermal exchange between environment and product to be transported such as to allow a length of conservation of the product to be transported within the desired range of temperatures equal to few hours, usually 1–2 hours.

In case of containers of the returnable type, such length can be prolonged by using refrigerating plates having a lower temperature than the desired temperature inside the container. The most used type of such plates consists of boxes made of polyethylene and filled with water solutions of ethylene or propylene glycol or other chemicals. Such containers are cooled inside cold-storage rooms or refrigerators and then positioned inside the isothermal containers mentioned above. Such refrigerated plates allow a length of conservation of the product to be transported within the desired range of temperatures equal to a few hours, usually 2–4 hours.

Of course, it is possible to use such solution only when the utilized isothermal container may be used again several times as the cost of the above-mentioned refrigerating plates is such as to make their recovery and reuse absolutely necessary. Such solution cannot be conveniently used in case the isothermal containers are of the disposable type, i.e. one-use containers, as in case of isothermal containers made of polystyrene. In the latter case, it is absolutely necessary to use a cold accumulation device which is not only technically effective but also of limited cost such as to make it possible to use such solution also from the economical point of view.

Furthermore, the use of such refrigerating plates causes not negligible problems. Before being used the empty container is usually stored in a suitable store which is under standard environmental conditions depending on the season during which such containers are used. Such environmental conditions can vary in the following ranges:

temperature: 20°/30° C.

relative humidity: 50/80%

The air of the environment under such conditions fills initially also the isothermal container.

When the product to be transported, which is taken out of the cold-storage rooms (such rooms being characterized by temperatures varying between −18° C. and 0–5° C.), is put into the isothermal container, the temperature of the air within the container decreases to a temperature near that of the product to be transported or the refrigerating plates located inside the container. This causes the relative humidity to increase till 100% so that such humidity begins to condense on the product to be transported, thus causing nearly always damages to the product or not negligible troubles.

SUMMARY OF THE INVENTION

The present invention relates to a solution solving the following problems:

- prolongation of the length of preservation of thermally perishable products transported by means of isothermal containers of the disposable or returnable type;
- control of the relative humidity inside the containers in order to avoid the condensation of the humidity on the transported products.

The solution provided by the invention solves particularly the problems relating to the transportation of thermally perishable products at temperatures higher than −18° C. In fact, for transportation at temperatures lower than −18° C. the solution already exists for a long time and consists of positioning a determined amount of dry ice (solid carbon dioxide) inside the isothermal container. The positioning inside the isothermal container is done quite at random. Dry ice has a balance temperature of −78.5° C. at atmospheric pressure and exchanges heat with the air inside the container and cools such air to temperatures lower than about −18° C. Such temperatures are exactly determined by a variety of factors such as the amount of dry ice used, the volume, the shape and the weight of the transported product, and the total thermal exchange factor of the thermal container used.

Such a method cannot be used for the transportation of thermally perishable products that need temperatures higher than −18° C. (such as fresh foodstuffs, drugs, etc.) In fact the use of dry ice and the presently used isothermal containers determines temperatures inside the container which are lower than −18° C., i.e. not consistent with the market requirements.

The present invention seeks to solve such problem by using a particular type of container. The solution consists of a container provided with partitions capable of forming suitably positioned compartments in which dry ice or other coolants can be placed.

Such partitions can be positioned differently according to requirements. To this end, they can engage to recesses formed in the side walls and in the bottom of the container.

A better understanding of the invention will result by referring to the accompanying drawings that show some containers according to the invention only by way of a not limiting example.

DESCRIPTION OF THE PREFERRED EMBODIMENTS

With reference to the Figures, the isothermal container is provided with some recesses (1) in the side walls (2), such recesses allowing partitions (3) to be positioned at will according to the requirements and the need for regulating the temperature and the humidity generated inside the container by varying the number of partitions and the amount of dry ice or coolant placed in the compartments formed by the partitions.

The partitions can be made of an isothermal material of the same type as the material used for making the isothermal container or different from such material. By way of example: container of foam polystyrene and partitions of polystyrene or container of foam polystyrene and partitions of polyethylene. The isothermal materials which can be used are of a variety of types: foam polystyrene, foam polyethylene, foam polypropylene, foam polyurethane, outside structure of polyethylene and inside walls of foam polyurethane, etc.

Figure 1:
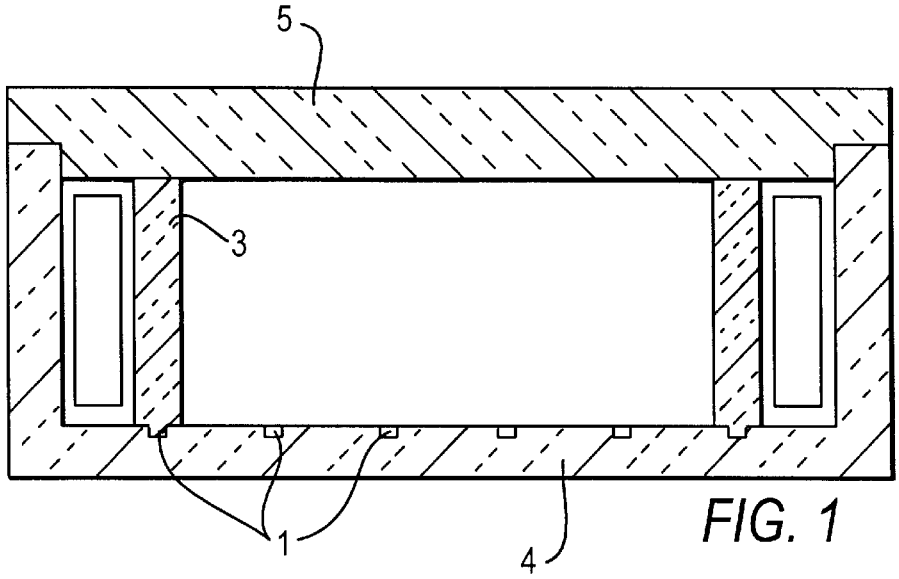
FIG. 1 shows a side view of a container having two side compartments for containing the coolant.
Figure 2:
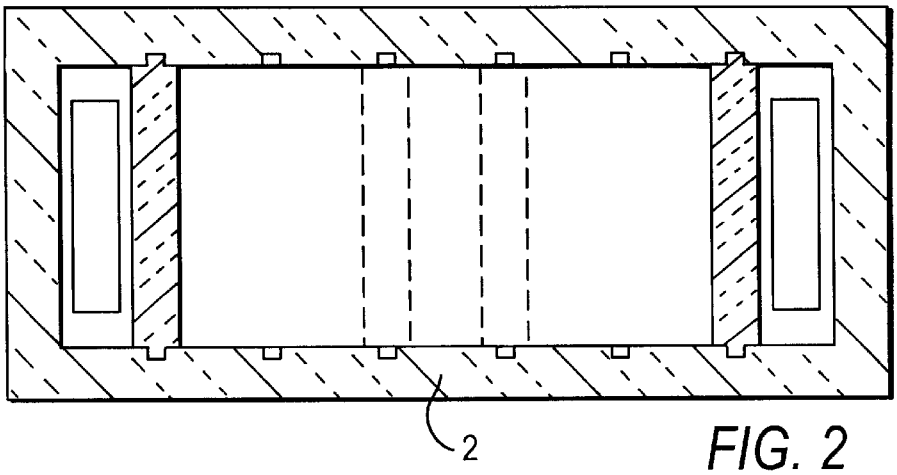
FIG. 2 shows a top plan view of the same container.

These partitions can be positioned in a variety of ways, as shown in FIGS. 1 and 2, i.e. inserted in recesses formed in the bottom (4) and the lid (5) so that the most tight possible closure is formed.

The use of one or more air spaces increases the refrigerating action. An increase of the refrigerating action can also be obtained by drilling the partitions more or less according to the desired refrigerating action. The length of keeping the temperature in the desired range is determined by the used amount of dry ice.

The gas developed by the sublimation of dry ice permeates to the outside through the porous walls made of foam material and through the spaces formed between the partitions and the walls of the container.

Figure 3:
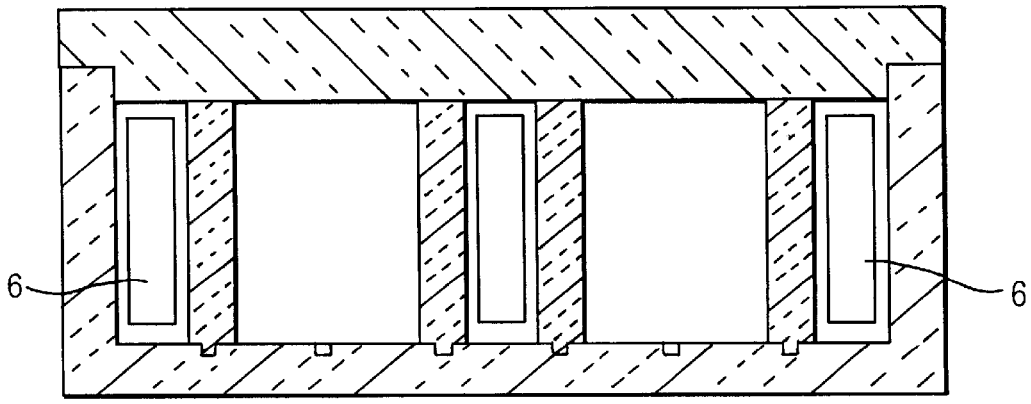
FIG. 3 shows a container also provided with a central compartment.

The compartments for ice (6) can also be formed by air spaces in the central portion of the container (FIG. 3), and dry ice in the form of bars of different size, pellets (small cylinders) of different size (diameter and length) or carbon snow, i.e. not compact solid carbon dioxide in the form of dry ice can be located in such compartments. Such positioning cause a cooling of the partition acting as refrigerating surface with respect to the inside volume of the container.

A portion of carbon dioxide developed by the sublimation of the dry ice permeates to the product in the container and decreases the relative humidity to 10% to 60% so that, the relative humidity inside the container is always kept lower than 100% and then humidity saturation conditions are never reached so that no humidity or condensed water can be seen on the product to be transported. The amount of carbon dioxide transferred to the product to be transported is also a function of the number and the section of the communication holes in the partitions.

Figure 4:
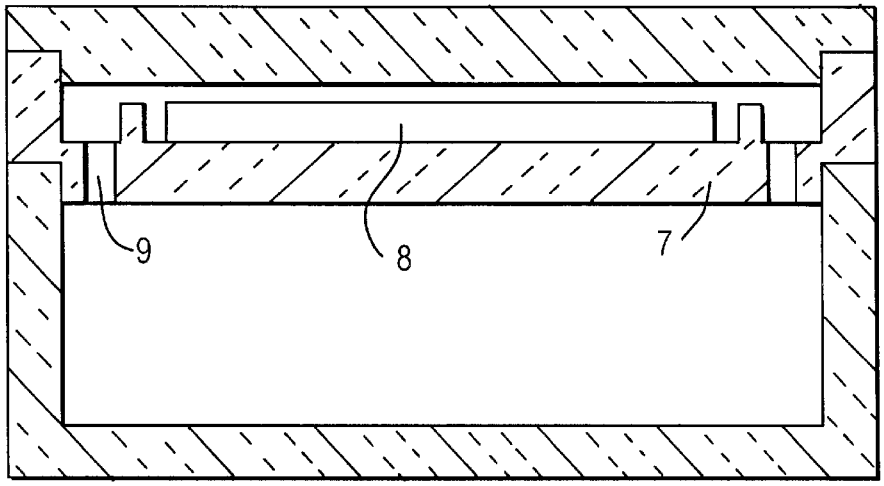
FIGS. 4 and 5 show a side view and a top plan view of a container whose compartment carrying the coolant is positioned high above under the lid, respectively.
Figure 5:
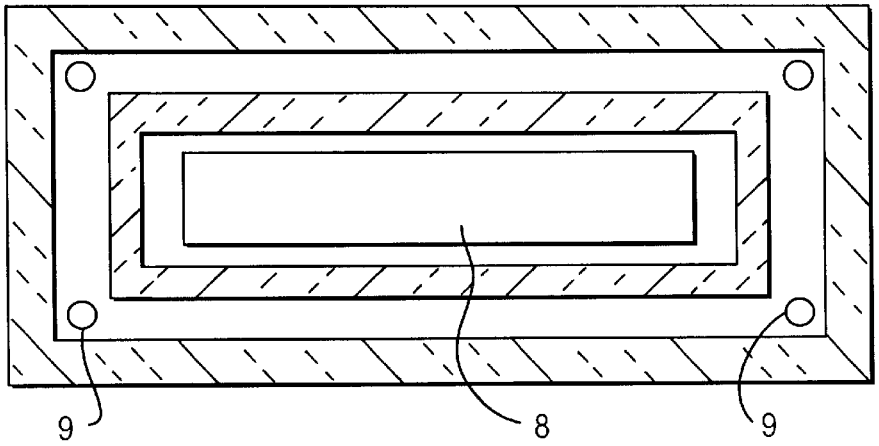
Figure 6:
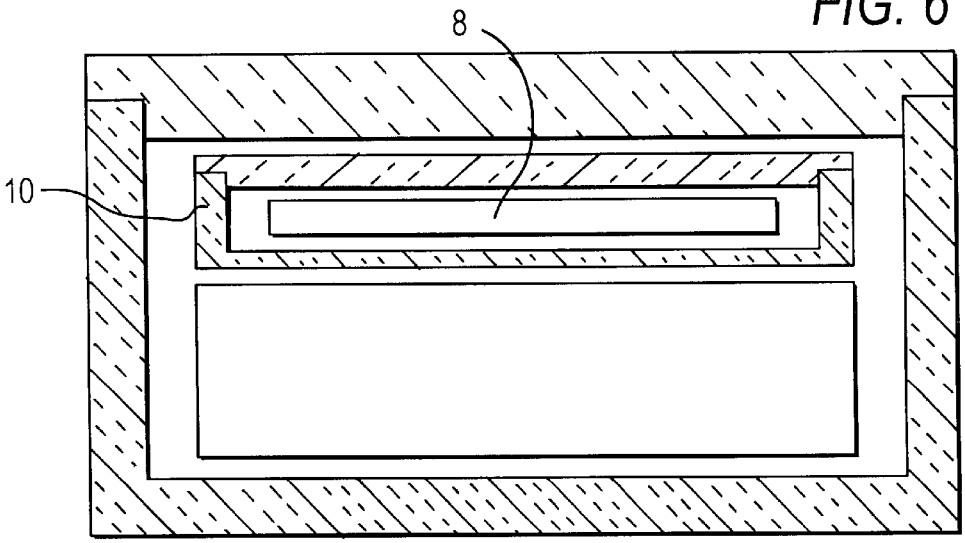
FIG. 6 shows a completely self-contained box for the ice inside the main container.

In the solution proposed in FIGS. 4–6 the partitions are replaced by a secondary lid (7) which is coupled to the container under the main lid connected thereto by the same fixed joint.

In addition, this secondary lid is shaped so that it can receive and contain dry ice within a compartment (8) formed therein. As such compartment is in contact with the dry ice, it cools and thus transfers units of refrigeration to the compartment containing the product to be transported. The wall thickness of the bottom of the secondary lid determines the cooling flow towards the compartment containing the product to be transported.

Such thickness can be easily adjusted by adding panels to or removing panels from the bottom of the secondary lid. The positioning of the secondary lid with respect to the product to be transported helps the uniform distribution of the cooling flow.

In order to promote the transfer of carbon dioxide towards the underlying compartment so that, the desired decrease in relative humidity can be obtained, the secondary lid is provided with some holes (9) that have the above-mentioned function. The number of holes also determines the amount of the thermal flow exchanged with the underlying compartment.

A similar result can be obtained by using standard isothermal containers, as shown in FIG. 6, and dry ice packaged in boxes made of polystyrene (10).

Dry ice can be used both in the form of bars of any size and pellets of a variety of size and carbon snow. The container made of polystyrene is used to isolate partially the dry ice and then to reduce the thermal exchange with the environment inside the isothermal container.

Thus, it is possible to achieve a temperature inside the container compatible with the requirements of the various applications. The inner temperature will be a function of the outer surface and the thickness of the walls of the compartment containing dry ice, under the same constant characteristics of the outer container carrying the product to be transported.

Also in this case it is obtained a control of the humidity inside the outer container due to the generation of carbon dioxide from the sublimation of dry ice container in the inner compartment.

The proposed containers can be of the disposable or returnable type and the selected materials can be very different from one another to match with the used coolants that can also be very different.

In any case, shape and construction modifications can be made to the proposed solution without departing from the scope of the present invention as defined in the appended claims.

What is claimed is:

1. An isothermal container for transporting thermally perishable products, comprising a plurality of walls limiting an inner space; partition means subdividing the inner space into at least one coolant accommodating chamber and a product accommodating chamber; and means for controlling a humidity in said product accommodating chamber, said humidity controlling means including hole means provided in said partition and allowing a flow of gas developed by sublimation of the coolant from said coolant accommodating chamber into said product accommodating chamber.

2. An isothermal container as defined in claim 1, wherein said hole means include a plurality of holes provided in said partition means.

3. An isothermal container as defined in claim 2, wherein said partition means include a plurality of partitions which are removably and alternatingly insertable in said walls and having different numbers of holes so as to adjust an amount of the flow.

4. An isothermic container as defined in claim 1, wherein said partition means include a plurality of partitions having different thicknesses, so as to adjust a temperature in said product accommodating chamber by influencing a cooling of said product accommodating chamber from said coolant accommodating chamber.

5. An isothermal container as defined in claim 1, wherein said partition means include a plurality of partitions, said walls having a plurality of grooves spaced from one another in a direction away from said coolant accommodating chamber, so that a different number of said partitions can be alternatively inserted in corresponding ones of said grooves so as to influence cooling of same product accommodating chamber from said coolant accumulating chamber.

6. A method of transporting thermally perishable products in an isothermic container, comprising the steps of providing in the container a plurality of walls limiting an inner space; subdividing the inner space by partition means into at least one coolant accommodating chamber and a product accommodating chamber; and controlling a humidity in said product accommodating chamber by hole means provided in said partition and allowing a flow of gas developed by sublimation of the coolant from said coolant accommodating chamber into said product accommodating chamber.

7. A method as defined in claim 6; and further comprising the step of forming said hole by a plurality of holes provided in said partition means.

8. A method as defined in claim 6; and further comprising the steps of providing in the partition means a plurality of partitions having different thicknesses, so as to adjust a temperature in said product accommodating chamber by influencing a cooling of said product accommodating chamber from said coolant accommodating chamber.

9. A method as defined in claim 6; and further comprising the steps of providing in the partition means a plurality of partitions; providing in said walls a plurality of grooves spaced from one another in a direction away from said coolant accommodating chamber; and alternatingly inserting a different number of said partitions in corresponding ones of said grooves so as to influence cooling of said product accommodating chamber from said coolant accommodating chamber.

* * * * *